US006691903B2

(12) United States Patent
West, Sr.

(10) Patent No.: US 6,691,903 B2
(45) Date of Patent: Feb. 17, 2004

(54) MULTIPLE RIBBON PRO BOW WRAPPING DEVICE

(76) Inventor: Marvin R. West, Sr., 1015 Cooper Lake Rd., Oneida, TN (US) 37841

( * ) Notice: Subject to any disclaimer, the term of this patent is extended or adjusted under 35 U.S.C. 154(b) by 0 days.

(21) Appl. No.: 10/126,800

(22) Filed: Apr. 19, 2002

(65) Prior Publication Data

US 2003/0197040 A1 Oct. 23, 2003

(51) Int. Cl.[7] ..... A41H 43/00
(52) U.S. Cl. ..... 223/46
(58) Field of Search ..... 223/46; 428/4, 428/5; 28/147, 149

(56) References Cited

U.S. PATENT DOCUMENTS

| | | | | | |
|---|---|---|---|---|---|
| 1,010,155 | A | | 11/1911 | Lange | |
| 1,307,069 | A | | 6/1919 | Weismantel | |
| 2,077,370 | A | | 4/1937 | Reynolds | |
| 2,569,943 | A | | 10/1951 | Mitchell | |
| 2,610,436 | A | | 9/1952 | Honeycutt | |
| 2,666,249 | A | | 1/1954 | Ruiz | |
| 2,763,080 | A | | 9/1956 | Welch | |
| 2,905,368 | A | * | 9/1959 | Runyon | 223/46 |
| 2,959,825 | A | | 11/1960 | Gould | |
| 3,377,674 | A | | 4/1968 | Brassaw et al. | |
| 3,462,049 | A | | 8/1969 | Smith | |
| 3,501,070 | A | | 3/1970 | Shattuck | |
| 3,816,888 | A | | 6/1974 | Rather, Jr. | |
| 4,449,652 | A | * | 5/1984 | Coppins et al. | 223/46 |
| 4,454,968 | A | | 6/1984 | StLawrence | |
| 4,629,100 | A | | 12/1986 | Owens | |
| 5,356,056 | A | | 10/1994 | Teuten | |
| 5,411,188 | A | | 5/1995 | Teuten | |
| 5,499,759 | A | | 3/1996 | Richards | |
| 5,617,979 | A | | 4/1997 | Cavender | |
| 5,662,250 | A | | 9/1997 | Werling | |
| D389,998 | S | | 2/1998 | Cavender | |
| 5,810,214 | A | * | 9/1998 | Hecht | 223/46 |
| 6,000,586 | A | | 12/1999 | Cavender | |
| 6,131,778 | A | | 10/2000 | Etzion | |

* cited by examiner

*Primary Examiner*—John J. Calvert
*Assistant Examiner*—James Smith
(74) *Attorney, Agent, or Firm*—Kirk A. Wilson

(57) ABSTRACT

A bow wrapping device having a base, a ribbon spool carriage removably coupled to the base and adapted to carry a plurality of ribbon spools, a guide retainer removably coupled to the base and adapted to retain ribbon fed from the ribbon spools, a rotating peg arm removably coupled to said base, at least one wrapping peg removably coupled to the peg arm, least one wrapping peg handle removably coupled to the peg arm, wherein said peg arm is adapted to rotate relative to the base and wrap a plurality of ribbons received from the guide retainer in a concentric looped pattern around the wrapping peg and wrapping peg handle.

14 Claims, 5 Drawing Sheets

MULTIPLE RIBBON PRO BOW WRAPPING DEVICE

FIELD OF THE INVENTION

This invention is a device to be used in making bows out of ribbon, and is more particularly concerned with a device that wraps single or multiple bows from single or multiple ribbon spools.

BACKGROUND OF THE INVENTION

Devices for making bows out of ribbon are common. For example, U.S. Pat. No. 5,810,214, to Hecht, teaches a bow-making device with a substantially rectangular base having a row of circular holes formed in the top surface thereof. The holes are adapted to receive pegs to be mounted on the base in an upright position. At an intermediate point in the row of holes a pair of hoops extends upwardly from the base. In use, a peg is placed in a respective hole on each side of the pair of hoops and a length of ribbon is wound around the pegs to form ribbon loops. The ribbon is passed between the hoops in a position such that the ribbon is held between the pegs by the pair of hoops.

U.S. Pat. No. 2,666,249, to Ruiz et al., teaches a bow-making device similar to Hecht's, in that Ruiz's jig also includes a row of holes into which pegs may be inserted. Instead of Hecht's pair of hoops, a slotted peg is provided at a central point in Ruiz's row of holes. The slotted peg is intended to constrain the loops of ribbon that are wound around rods on opposite sides of the slotted peg.

Bow tiers provided according to the prior art generally require the user to manually wrap the ribbon around a stationary portion of the bow and remove the ribbon from pegs having no camber angle. This inventive device improves the bow production process and speed by using a rotating peg arm to form specific sized concentric loops of ribbon that are easily removed from the device and subsequently tied and formed into a decorative bow. The device maintains adequate ribbon tension during wrapping. The wrapping peg boring is drilled into the peg arm at a preselected camber angle to tilt the wrapping peg inward for easy lifting of the wrapped loops of ribbon from the device. Multiple ribbons and bows can be wrapped simultaneously by stacking ribbon spools on the carriage.

BRIEF SUMMARY OF THE INVENTION

According to one aspect of the invention, there is provided a bow wrapping apparatus having a base, a ribbon spool carriage removably coupled to the base and adapted to carry a plurality of ribbon spools, a guide retainer removably coupled to the base and adapted to retain ribbon fed from the ribbon spools, a peg arm removably coupled to the base, at least one wrapping peg removably coupled to the peg arm, at least one wrapping peg handle removably coupled to the peg arm, wherein said peg arm is adapted to rotate relative to the base and wrap a plurality of ribbons received from the guide retainer in a concentric looped pattern around the wrapping peg and wrapping peg handle.

It is accordingly an advantage of the invention to provide a bow wrapper that wraps ribbon fed from single or multiple ribbon spools of same or different colored ribbon.

It is another advantage of the invention to provide a bow wrapper that wraps multiple bows simultaneously. The bows can be the same size or different sizes.

It is another advantage of the invention to provide a bow wrapper that enables easy removal of the ribbon from the pegs after wrapping is completed.

It is another advantage of the invention to provide a bow wrapper that is useful in making a wide variety of different bow sizes. Incremental wrapping peg holes in the peg arm provide positions for wrapping various sized bows.

It is another advantage of the invention to provide a bow wrapper that is useful in making a wide variety of different types of bows. A bow can be made with the instant invention using the entire apparatus or by removing the rotating peg arm and using the arm alone for a stationary wrapping station.

DETAILED DESCRIPTION OF THE INVENTION

Figure 1:
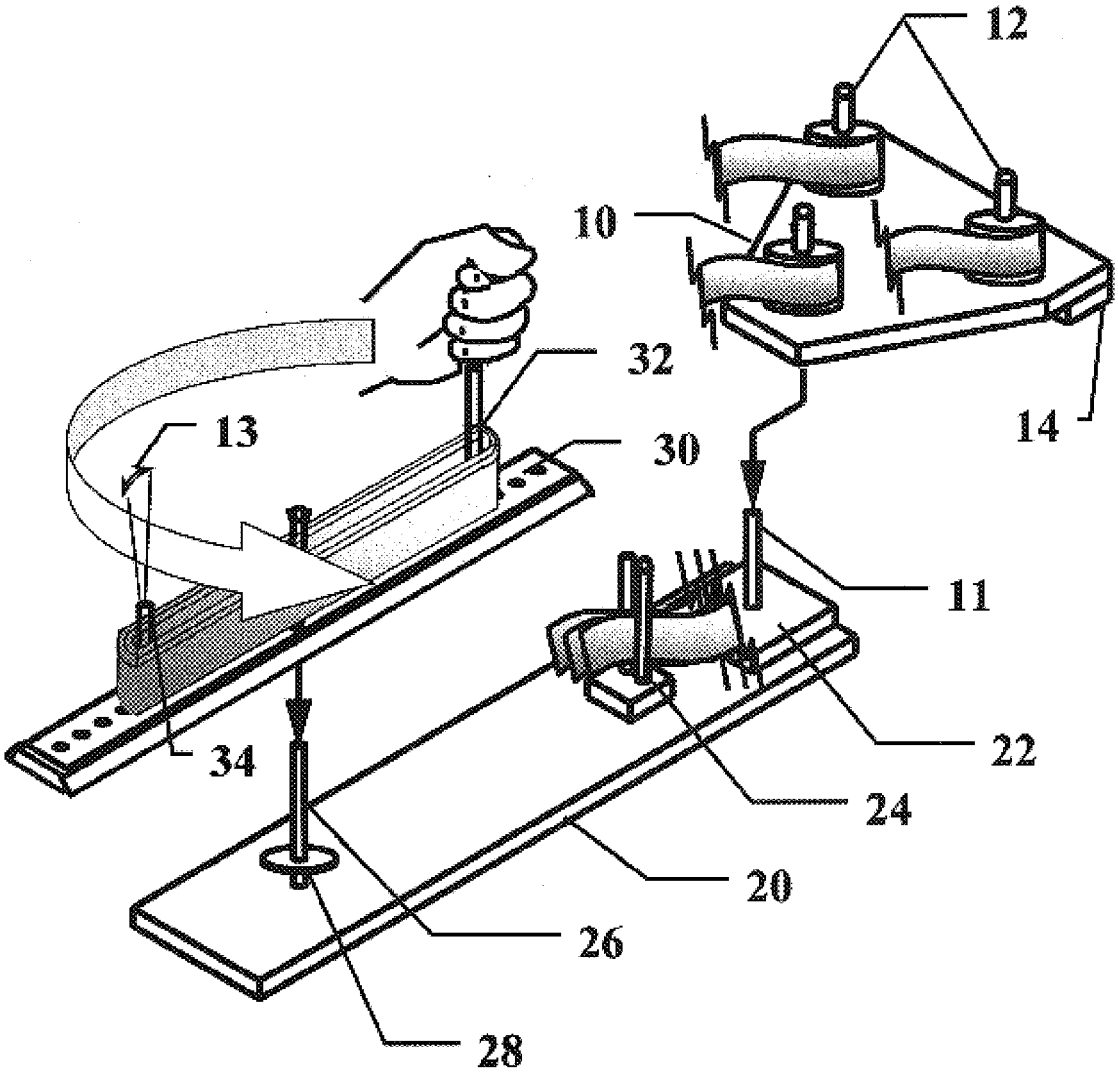
FIG. 1 is an unassembled perspective of a bow wrapper provided in accordance with the invention wrapping a single bow with multiple ribbons.
Figure 2:
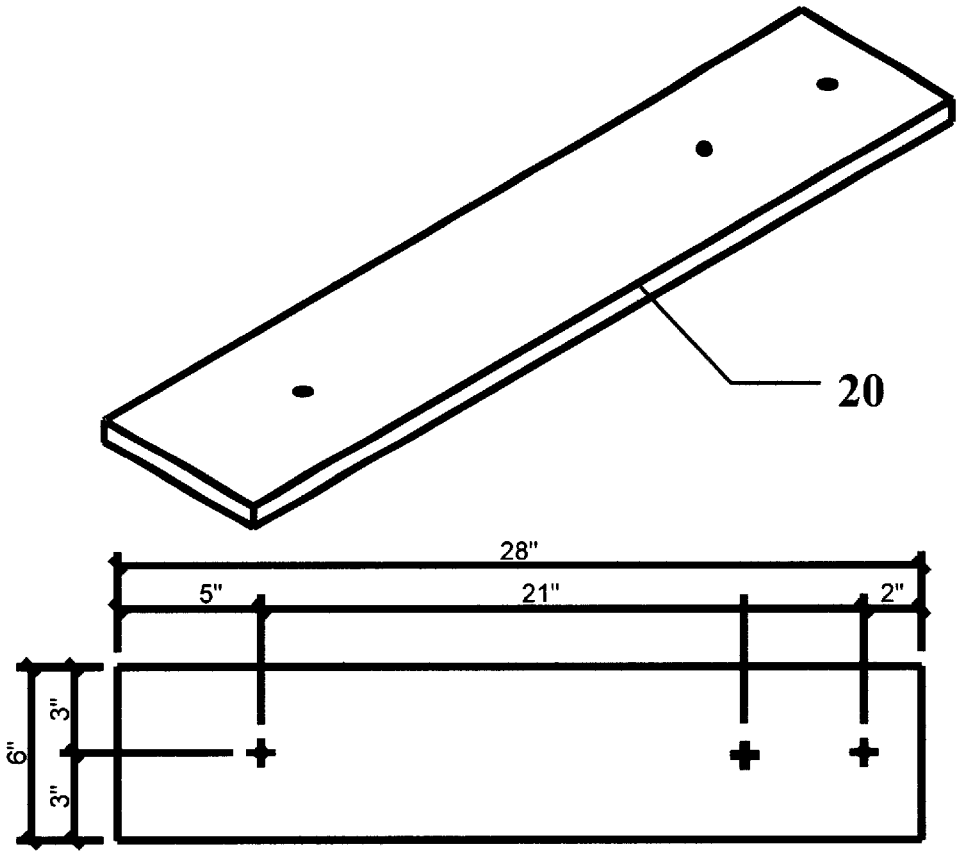
FIG. 2 is a perspective and plan view of a bow wrapper base provided according to the invention.
Figure 3:
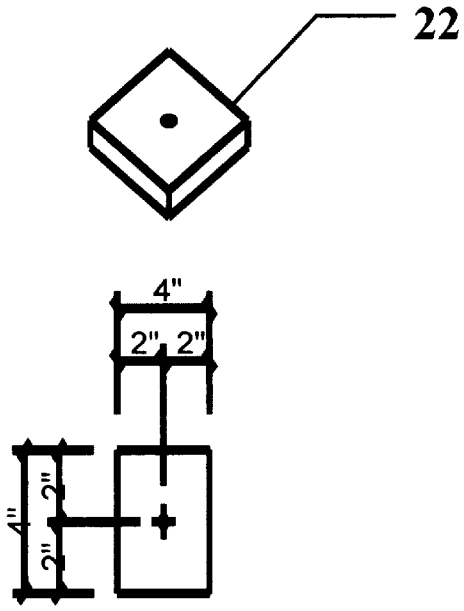
FIG. 3 is a perspective and plan view of a carriage mount which is a component of the bow wrapper.
Figure 6:
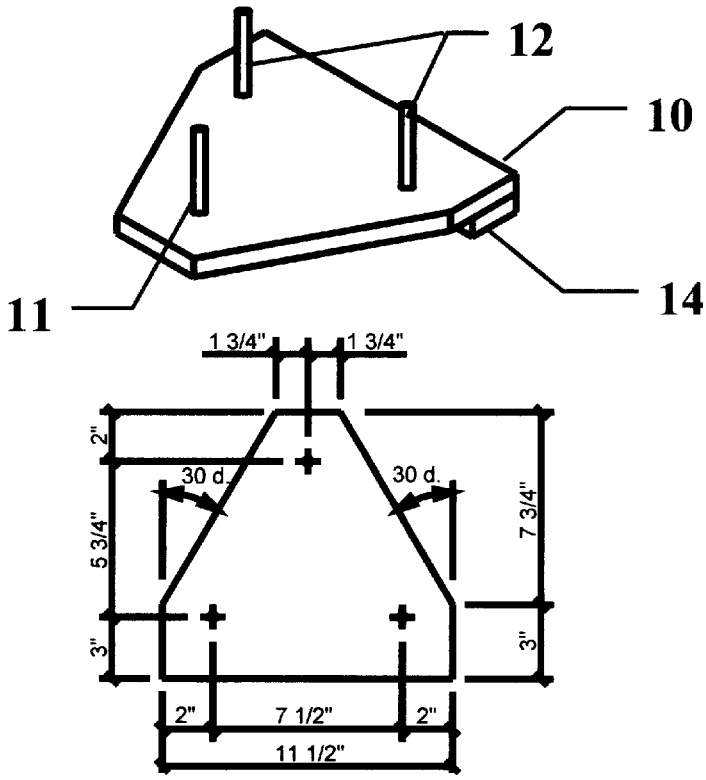
FIG. 6 is a perspective and plan view of a ribbon spool carriage.
Figure 7:
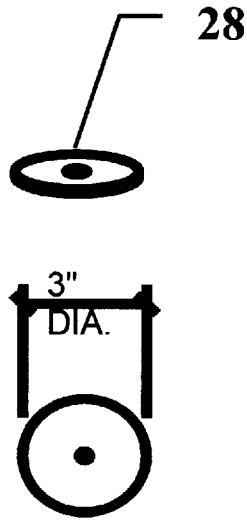
FIG. 7 is a perspective and plan view of a peg arm mount spacer.

A preferred embodiment of the bow wrapper provided in accordance with the invention will now be described. With reference to FIG. 1, the bow wrapper base 20 serves to mount the components of the bow wrapper and stabilize the apparatus during operation. The base 20 can be either fixed or portable and can be various configurations with any suitable means for stabilization. Removably coupled to the base 20 is a ribbon spool carriage mount 22 bored for retaining a forward ribbon spool peg 11. This forward spool peg 11 serves as both a ribbon spool peg and a carriage mount post for positioning and removably connecting the ribbon spool carriage 10 to the base 20. The ribbon spool carriage 10 rotates freely around the forward spool peg 11 such that the carriage 10 can be positioned for best ribbon feeding during single or multiple spool operations. Removably coupled to the ribbon spool carriage 10 is at least one ribbon rear spool peg 12 that retains spools having different or same color ribbon. Spool pegs 11 and 12 retain ribbon spools that are positioned such that all ribbon is aligned in a single wrapping plane essentially parallel to said carriage. This single wrapping plane alignment prevents ribbon interference when feeding from multiple ribbon spools and provides concentric overlapping alignment of ribbon during wrapping. Another view of the ribbon spool carriage 10 is seen in FIG. 6.

Figure 4:
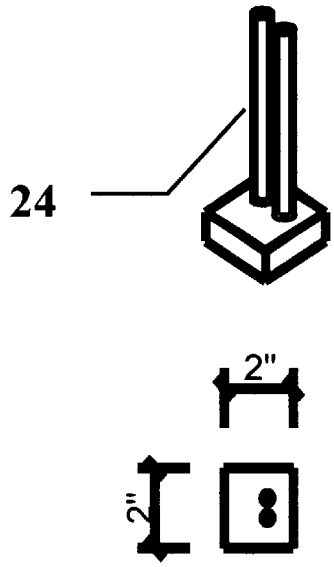
FIG. 4 is a perspective and plan view of a ribbon guide retainer.

The ribbon from each spool mounted on at least one forward spool peg 11 or rear spool peg 12, is threaded through a gap between the vertical posts of ribbon guide retainer 24 that is removably coupled to the base 20. Another view of the guide retainer 24 is shown in FIG. 4. The ribbon leaves the guide retainer 24 en route to the rotating peg arm 30.

The peg arm mount 26 is removably coupled to the base 20 and serves as a central post and rotating axis for removably coupling the rotating peg arm 30 to the base 20. The peg arm mount 26 also serves as the beginning post to wrap and pin the leading edges of ribbon to prior to starting rotation. The peg arm mount spacer 28 provides clearance between the peg arm 30 and the base 20 during rotation.

Figure 5:
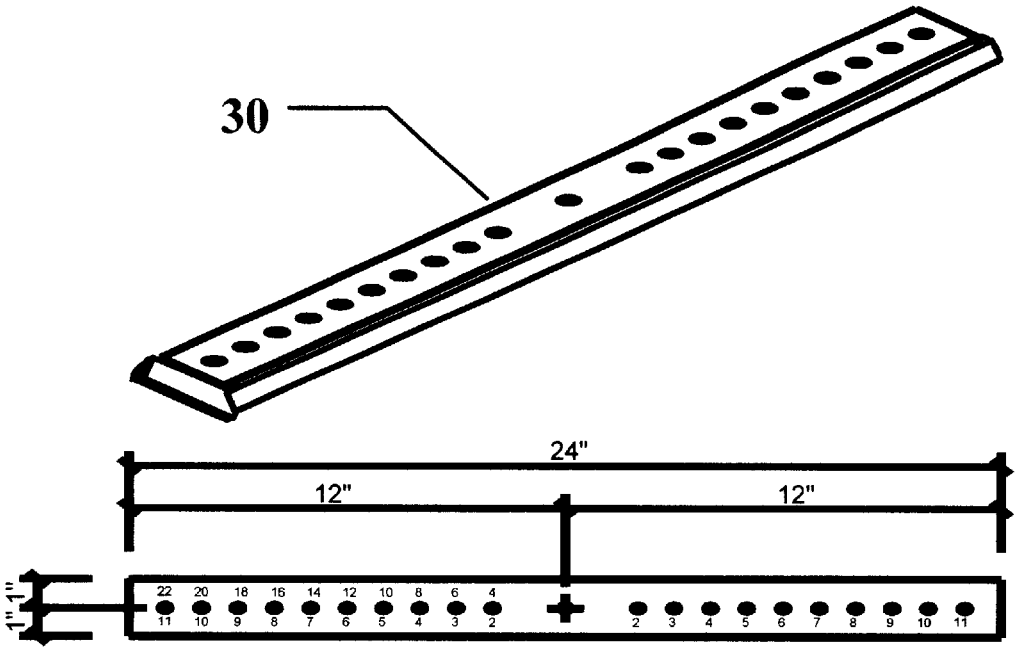
FIG. 5 is a perspective and plan view of a peg arm.

FIG. 5 shows peg arm 30 that is match drilled, or bored, at incremental distances from the center to receive wrapping pegs and facilitate making various bow sizes. Bow sizes in the range of 2 to 22 inches outside diameter can be made with the peg arm 30 shown but extending the length of peg arm 30 can make larger bows. The peg arm borings are only sufficient depth to removably retain and press fit the wrapping peg 34 into the peg arm 30. Wrapping peg handle 32 borings are slightly oversized to enable the handle to spin inside its respective boring. Wrapping peg 34 borings are made at a preselected camber angle 13 away from vertical such that when mounted to the peg arm 30, the top of wrapping peg 34 is tilted toward the center of the peg arm to facilitate removal of the ribbon on completion of wrapping. The camber angle 13 can be between approximately 5 and 30 degrees. Perimeter edges of peg arm 30 are rounded or slanted to prevent snagging the ribbon during rotation.

Figure 9:
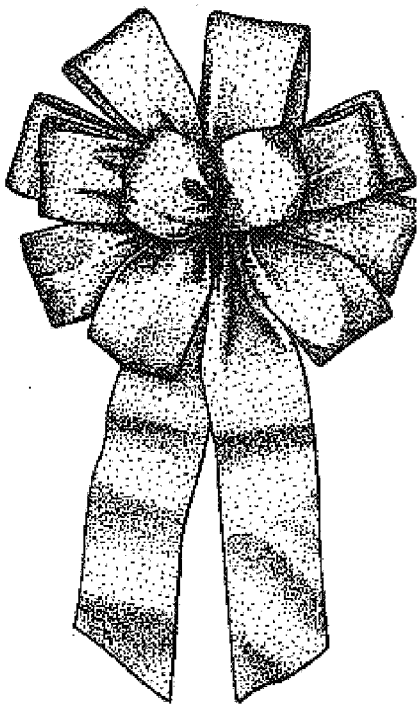
FIG. 9 is a plan view of a decorative bow made using the instant invention.

In accordance with the illustrations, the bow wrapping operation is started by assembling all components of the bow wrapper onto a stable support that will prevent unnecessary movement of the bow wrapper during operation. The ribbon spool carriage 10 is then loaded with at least one ribbon spool of a preselected color and material. If multiple spools are desired, additional spools of varying or similar color material can be loaded on the ribbon spool carriage 10 and threaded through the guide retainer 24 before being removably pinned to the peg arm mount 26 as a starting hold. Wrapping peg 34 and wrapping peg handle 32 are then inserted into their respective borings at the desired bow size as marked on peg arm 30. It is also possible to wrap using only the peg arm mount 26 and the wrapping peg handle 32 when smaller bows are desired. The peg arm 30 is then rotated around the peg arm mount 26 axis a sufficient number of times to create the number of concentric loops desired in the bow. For example, if a 12-inch diameter bow is desired, the wrapping peg handle 32 and the wrapping peg 34 are placed in the peg borings marked "6" which signifies 6 inches from center. The peg arm 30 is then rotated 12 full revolutions for a single ribbon feed and 12 concentric loops of ribbon are formed. Rotation of the peg arm 30 is stopped and the wrapped ribbon is carefully lifted intact from the wrapping pegs. While intact, the concentric loops are folded once along the central axis vacated by the peg arm mount 26. Holding the ribbon in the folded position, the two ribbon corners formed along the fold axis are clipped at an angle to remove excess ribbon from the tying area and to provide a narrowed ribbon center seam for placement of a tie wire. A tie wire or similar tying material is then wrapped around the narrowed ribbon center seam and twisted onto itself to secure the center seam. Individual loops originating from the center seam are then spread apart and twisted in an organized fashion then positioned relative to each other to make a decorative bow as seen in FIG. 9. The preferred appearance of the decorative bow is formed when wrapping is performed in accordance with the following table:

| | | | Number of Peg Arm Rotations | | |
|---|---|---|---|---|---|
| Bow Diameter (inches) | Wrapping Peg Position | Wrapping Peg Handle Position | Single Ribbon Feed | Dual Ribbon Feed | Triple Ribbon Feed |
| 2 | N/A | 2 | 2 | 1 | N/A |
| 4 | 2 | 2 | 4 | 2 | 1 |
| 6 | 3 | 3 | 6 | 3 | 2 |
| 8 | 4 | 4 | 8 | 4 | 2.5 |
| 10 | 5 | 5 | 10 | 5 | 3 |
| 12 | 6 | 6 | 12 | 6 | 4 |
| 14 | 7 | 7 | 14 | 7 | 4.5 |
| 16 | 8 | 8 | 16 | 8 | 5 |
| 18 | 9 | 9 | 18 | 9 | 6 |
| 20 | 10 | 10 | 20 | 10 | 6.5 |
| 22 | 11 | 11 | 22 | 11 | 7 |

Figure 8:
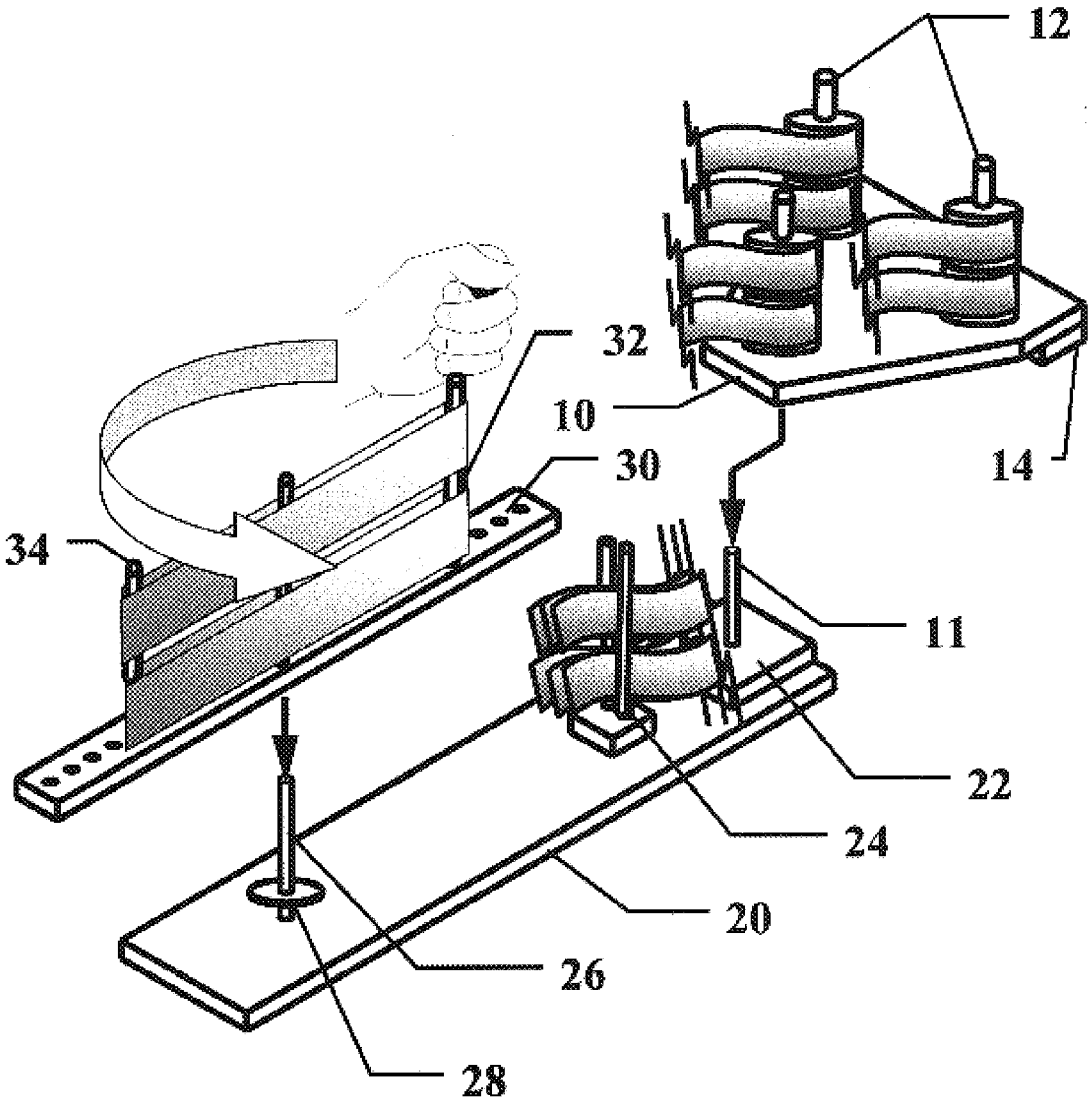
FIG. 8 is an unassembled perspective of a bow wrapper provided in accordance with the invention wrapping two bows simultaneously with multiple ribbons.

FIG. 8 shows an embodiment of the instant invention wherein two separate bows are wrapped simultaneously using stacked ribbon spools on the carriage. Each bow is constructed in the same manner as a single bow. Each bow is lifted from the device separately and then tied and formed as individual bows.

The bows shown in FIG. 8 are the same diameter but different diameter bows can be wrapped by elevating the rotating peg arm 30 on the peg arm mount 26 such that one bow is wrapped on the upper side the rotating peg arm 30 and a second bow is wrapped on the under side of the rotating peg arm 30. Additional wrapping pegs (not shown) must be removably coupled to the under side of the elevated rotating peg arm 30 and these wrapping pegs can be positioned different from those on the upper side of the rotating peg arm 30 thereby enabling different size bows to be wrapped simultaneously.

Figure 10:
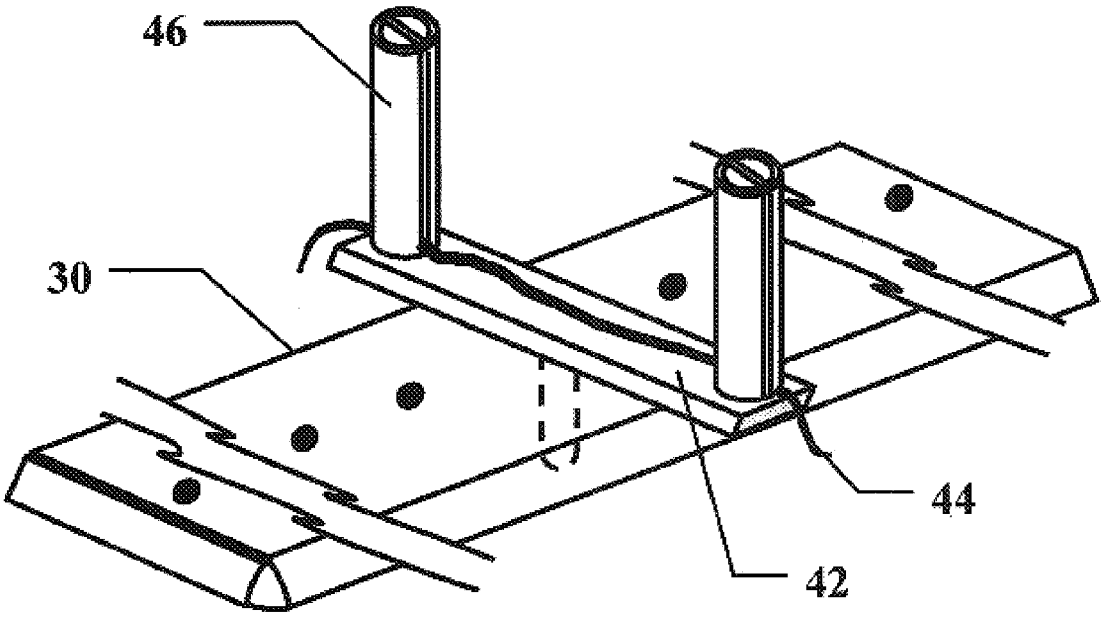
FIG. 10 is a perspective view of the invention embodiment having a fixed peg arm and tie wire fixture.

Another embodiment of the invention, shown in FIG. 10, uses the rotating peg arm 30 in a stationary mode as a stand-alone arm for manual wrapping. This embodiment is used in the same manner as taught in U.S. Pat. 6,000,586, which is herein incorporated by reference. In this embodiment, the tie wire fixture 42 is removably coupled to the stationary peg arm 30 using the hole vacated by the peg arm mount 26. When wrapping bows in this embodiment, the wrapping peg 34 and the wrapping peg handle 32 are removed and the incremental measurements on the peg arm 30 are used to manually loop and overlay the ribbon flat onto the peg arm 30 at a preselected length while gathering the center of the bow between the tie wire fixture posts 46 for tying. A tie wire 44 is positioned into slots of the tie wire fixture posts 46 prior to wrapping such that when wrapping is complete, the ribbon laying between tie wire fixture posts 46 can be easily gathered and secured with tie wire 44.

According to a preferred embodiment of the invention, all components of the bow wrapper are made of wood. However, other materials may be used. For example, all of the components may be formed of plastic, polypropylene, hard rubber, metal or any other material that has a degree of natural elasticity.

It should further be understood that no particular ribbon-securing mechanism is essential to the invention. For example, the wrapping pegs may be arranged to be hollow cylinders, open at least at one end, and the ribbon-securing mechanism may include a clip shaped like a bobby-pin or a paper clip which may be slidingly engaged with the wall of the hollow peg, to secure the ribbon loop at the outer surface of the peg wall.

The wrapping pegs shown herein are substantially cylindrical, but pegs having a non-circular cross-section, such as square or rectangular may be used. Of course, the peg arm holes should have a shape that is matched to the cross-section of the pegs.

The removably coupled wrapping pegs shown herein function as members around which the ribbon is wound during a bow-making operation. However, instead of removably coupled pegs, the present invention may be constructed with uprights which are fixedly mounted in the peg arm and which have ribbon-holding means such as the clips described herein. For example, wooden pegs may be permanently mounted in holes in the peg arm by means of glue or the like. Alternatively, the peg arm and upright members may be integrally formed as a single body of molded plastic.

It is expected that bow-makers would achieve a higher rate of production and higher quality bows using the instant invention. The bow wrapping device maintains adequate tension on the ribbons during production and provides for multiple ribbon feeds. Multiple bows can be wrapped simultaneously by stacking ribbon spools on the carriage.

Various changes to the foregoing device may be introduced without departing from the invention. The particularly preferred apparatus described herein is thus intended in an illustrative and not limiting sense. The true spirit and scope of the invention are set forth in the following claims.

What is claimed is:

1. A bow wrapping device, comprising;

a base, a ribbon spool carriage removably coupled to said base at a carriage mount post, said carriage and having a plurality of spool pegs adapted to carry a plurality of ribbon spools, wherein said carriage is freely rotatable about said carriage mount post, and, wherein said ribbon spools are positioned such that all ribbon forming each bow is aligned in a single wrapping plane essentially parallel to said carriage, a guide retainer removably coupled to said base and adapted to retain ribbon fed from said ribbon spools, a peg arm mount removably coupled to said base, a peg arm removably coupled to said peg arm mount, at least one wrapping peg removably coupled to said peg arm, at least one wrapping peg handle removably coupled to said peg arm, wherein said peg arm is adapted to rotate relative to said base and wrap a plurality of ribbons received from said guide retainer in a concentric looped pattern around said wrapping peg and said wrapping peg handle.

2. The bow wrapping device of claim 1 wherein said base is fixed or portable.

3. The bow wrapping device of claim 1 wherein the outside diameter of bows made with said device is in the range of approximately 2 to 22 inches.

4. The bow wrapping device of claim 1 wherein said wrapping peg is mounted at a preselected camber angle in the range of approximately 5 and 30 degrees.

5. The bow wrapping device of claim 1 wherein the perimeter edges of said peg arm are rounded or slanted.

6. The bow wrapping device of claim 1 wherein said spool pegs, guide retainer, peg arm mount wrapping pegs, and wrapping peg handle are elongated for simultaneously wrapping multiple bows, wherein each bow has a separate wrapping plane.

7. The bow wrapping device of claim 1 constructed from material selected from the group consisting of wood, plastic, polypropylene, hard rubber, and metal.

8. A bow wrapping device, comprising;

a base, a ribbon spool carriage removably coupled to said base at a carriage mount post, said carriage having a plurality of spool pegs adapted to carry a plurality of ribbon spools, wherein said carriage is freely rotatable about said carriage mount post, and, wherein said ribbon spools are positioned such that all ribbon forming each bow is aligned in a single wrapping plane essentially parallel to said carriage, a guide retainer removably coupled to said base and adapted to retain ribbon fed from said ribbon spools, a tie wire fixture removably coupled to said base, a peg arm removably coupled to said tie wire fixture, wherein said peg arm is in a fixed position to manually loop and overlay a plurality of ribbons received from said guide retainer in a flat stacking pattern.

9. The bow wrapping device of claim 8 wherein said base is fixed or portable.

10. The bow wrapping device of claim 8 wherein the outside diameter of bows made with raid device is in the range of approximately 2 to 22 inches.

11. The bow wrapping device of claim 8 constructed from material selected from the group consisting of wood, plastic, polypropylene, hard rubber, and metal.

12. A method of making a bow comprising the steps of;

loading multiple ribbon spools onto a spool carriage, said carriage being freely rotatable about a carriage mount post, and, wherein said ribbon spools are positioned such that all ribbon forming each bow is aligned in a single wrapping plane essentially parallel to said carriage, threading ribbons from said ribbon spools through a guide retainer, pinning said ribbons to a peg arm mount, press fitting a wrapping peg and wrapping peg handle into said peg arm at a preselected position for a preselected bow size, rotating said peg arm around the peg arm mount axis sufficient revolutions to form the number of concentric loops necessary for said preselected bow size, lifting the intact concentric loops from said wrapping peg and wrapping peg handle, folding said intact concentric loops along a fold axis vacated by said peg arm mount, clipping excess ribbon along the two ribbon comers at the fold axis thereby forming a narrowed ribbon center seam, tying the concentric loops together at said narrowed ribbon center seam, spreading apart and twisting said concentric loops in an organized fashion, positioning said loops relative to each other to form a decorative bow.

13. The method of claim 12 wherein the outside diameter of the bow is in the range of approximately 2 to 22 inches.

14. The method of claim 12 wherein said ribbon spools are stacked to wrap at least two concentric loops simultaneously, wherein each loop is wrapped in a separate wrapping plane.

* * * * *